US006583568B1

(12) United States Patent
O'Meara

(10) Patent No.: US 6,583,568 B1
(45) Date of Patent: Jun. 24, 2003

(54) METHOD AND APPARATUS FOR DIMMING HIGH-INTENSITY FLUORESCENT LAMPS

(75) Inventor: Kevan O'Meara, Chatsworth, CA (US)

(73) Assignee: Northrop Grumman, Woodland Hills, CA (US)

( * ) Notice: Subject to any disclaimer, the term of this patent is extended or adjusted under 35 U.S.C. 154(b) by 0 days.

(21) Appl. No.: 10/028,048

(22) Filed: Dec. 19, 2001

(51) Int. Cl.[7] ..... H05B 37/02

(52) U.S. Cl. ..... 315/DIG. 4; 315/194; 315/209 R; 315/291

(58) Field of Search ..... 315/DIG. 4, 194, 315/199, 209 R, 307, 219, 222, 221, 223, 224, 291

(56) References Cited

U.S. PATENT DOCUMENTS 4,651,060 A * 3/1987 Clark ..... 315/199
5,939,830 A * 8/1999 Praiswater ..... 315/DIG. 4
6,229,271 B1 * 5/2001 Liu ..... 315/291
6,469,922 B2 * 10/2002 Choi ..... 315/DIG. 4

* cited by examiner

*Primary Examiner*—Hoang Nguyen

(57) ABSTRACT

A fluorescent ballast control process for a fixed and variable frame rate method of driving a fluorescent ballast to control the brightness of a fluorescent lamp load over a brightness range. The fixed frame rate process uses a fixed number of pulses in each frame. The variable frame rate process uses a variable number of pulses in each frame. When the two processes are combined, the control is gradual in response to a user control signal (BRIGHT). The transition from the fixed to the variable frame rate control process occurs seamlessly as the variable BRIGHT×BRIGHT×OVER where BRIGHT×OVER is calculated.

21 Claims, 8 Drawing Sheets

METHOD AND APPARATUS FOR DIMMING HIGH-INTENSITY FLUORESCENT LAMPS

BACKGROUND OF THE INVENTION

1. Field of the Invention

The present invention relates to the field of fluorescent drive ballasts and more particularly to the field of control processes for driving solid state fluorescent drives. The process taught herein relates to a method for mechanizing the control of drive OFF TIME, and drive ON TIME.

2. Description of Related Art

Recently, fluorescent lamps have been used for back lighting of LCD displays, typically in notebooks and other similar consumer applications as well as for military applications including GPS navigational aids. The lamps for such applications are small and are used alone or in combinations of up to four or more lamps depending on the size of the display. Such lamps have a maximum brightness range of 5:1, and their efficiency is slightly more important than for home or office lighting.

In military, industrial and law enforcement applications, LCD displays using fluorescent lamps are found in aircraft cockpits and other high technology applications. Such applications employ one to forty, or more, lamps in combination and represent examples of high-power density applications with 100 watts or more for a single 6"×9" display. The information displayed on such displays must be visible in direct sunlight and have a dimming range of over 500:1, and they must operate with high efficiency.

Prior art methods for dimming such light arrays typically vary the duty cycle of the AC drive to the lamp, while keeping the drive frequency constant, or they vary the current to the lamp while maintaining a 100% duty cycle.

Varying the brightness by varying the duty cycle limits the dimming control range. The dimming range is the ratio of the modulation frequency to the lamp drive frequency or frame rate where each sequence of drive pulses occurs within a frame of time of predetermined duration. By way of example, for a typical 40 KHz pulse rate drive, each pulse has a duration of 25 us. If the frame rate is 200 Hz, each frame has a duration of 5 ms which is enough time for 200 pulses having a duration of 25 us. Since the lowest number of integer pulses is one per frame, a dimming range of 200:1 is theoretically possible. However, tests have shown that only 50:1 may be achieved in practice, because lamp flicker develops as the number of pulses in a set is reduced to less than four pulses per set. In addition, as the number of pulses in a set increases from a 1 pulse set, to a 2 pulse set, it can be seen that the power to the lamp per frame is doubled. Even if the flicker problem did not exist, the granularity of the adjustment where fewer than four pulses are provided per frame is therefore inadequate at the minimum brightness levels.

Therefore, a need exists for an optimum dimming control for use in a back light display requiring up to a 10,000:1 brightness range for use with small sized fluorescent lamps in daylight readable displays.

SUMMARY OF THE INVENTION

A first advantage of the present invention is that it allows a wide range of control of the lamp's brightness, with no discontinuities or steps.

A fixed frame rate process is used for the high brightness regime and a variable frame rate process is used for the low brightness regime. The variable frame rate process uses a variable OFF TIME and a fixed ON TIME for each frame period.

The eye is less sensitive to flicker at lower lamp frequencies and at lower rightness levels. The variable frame rate process therefore more closely matches the properties of the eye by providing low brightness levels at low modulation frequencies.

The process of FIG. 6 also reduces or eliminates the effect of discrete changes in brightness at the low brightness levels at the lowest end of the dimming range; a problem common to the fixed frame rate control process. Smooth brightness control with fine resolution is obtained with drive frequencies extending from a transition frequency, at which control changes from a fixed frame rate to a variable frame rate, and extends downward to a lowest frame rate limit, established by a variable OFFTIME. Brightness ranges of over 1000:1 have been obtained.

In a first alternative embodiment, the fluorescent ballast control process includes a low brightness process or routine which uses a variable frame rate with a fixed even number of drive pulses in each frame, to control the brightness of the lamp load over a brightness range extending from a lowest brightness level through a lowest brightness range up to a predetermined intermediate brightness level.

A high brightness control process using a fixed frame rate is used to control the brightness of the fluorescent lamp load over a brightness range extending from a the intermediate brightness level through a high brightness range up to a predetermined maximum brightness level.

The process taught transitions the lamp load brightness from the low brightness control process to the high brightness control process in response to an input signal BRIGHT passing through the control range of values. The transitioning process presented provides for a matched slope at the transition point so that the change from the high to low or low to high brightness range under command of the RIGHT signal is seamless, i.e., without a perceptible jump in brightness as the transition is completed.

DETAILED DESCRIPTION

Figure 1:
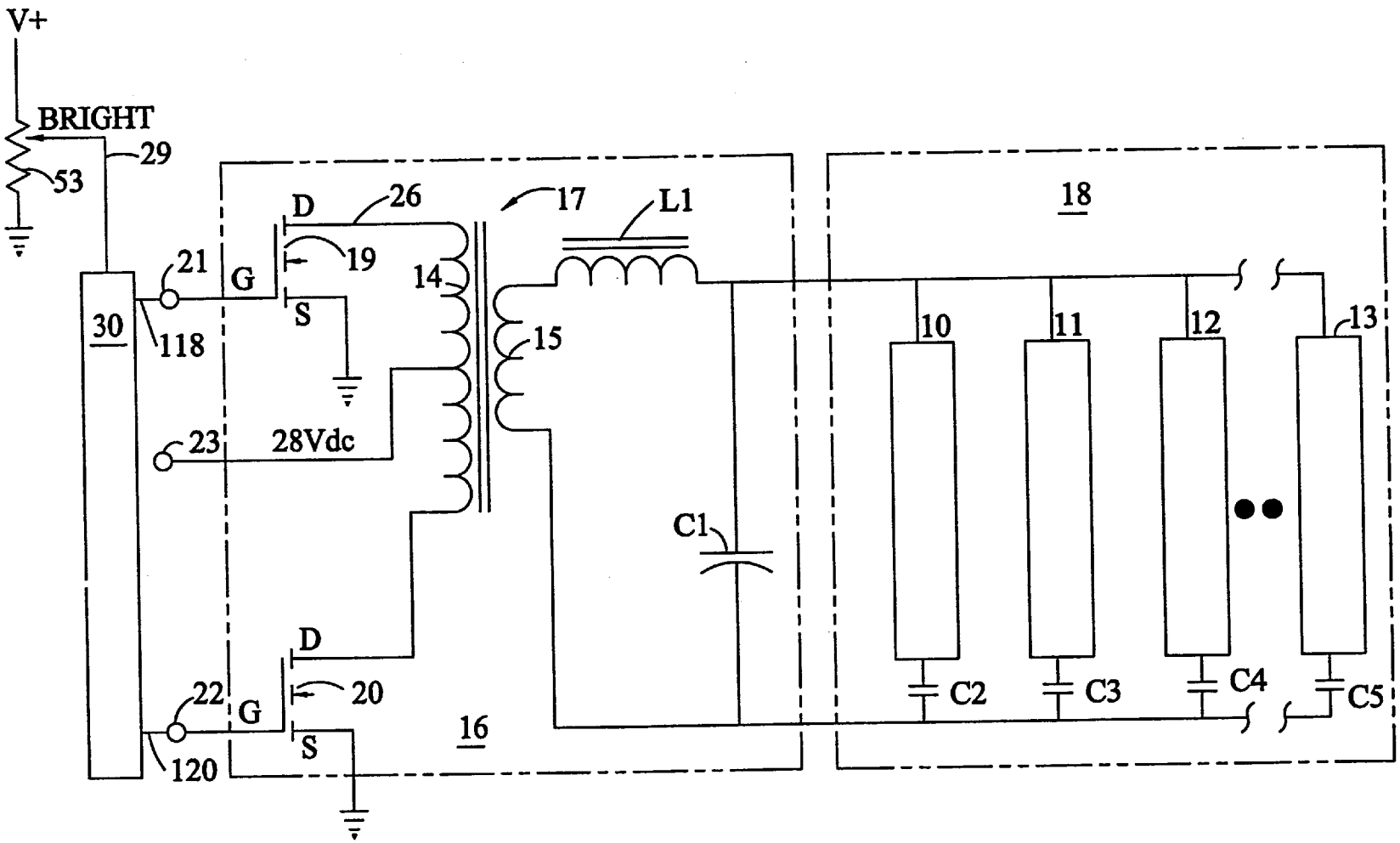
FIG. 1 is a schematic circuit diagram showing the conventional topology for a semi-resonant fluorescent ballast.

FIG. 1 shows the schematic diagram of a typical ballast drive circuit within phantom block 16 for a fluorescent lamp load depicted as a multiplicity of fluorescent lamps 10 through 13 within phantom block 18. As shown, the bottom of each of the lamps 10–13 is coupled via a respective capacitor C2, C3, C4, CS to one side of secondary windings 15 of a transformer 17. The other respective terminal of the lamps 10–13 are coupled in common through an inductor L1 to the other side of the windings 15. A capacitor C1 is coupled across the parallel connections of the lamps 10–13. The inductor L1 and capacitor C1 in combination with the lamp load form a damped reactive load which when driven by the switch-mode drive from transformer 17 provides a quasi-sinusoidal drive to the lamp load.

The primary winding 14 of the transformer 17 is coupled to a pair of switching transistors 19 and 20. The transistors 19 and 20 are MOSFET's, or IGFETs each FET having a gate terminal G coupled to respective terminals 21 and 22 of the lamp power drive circuit. Terminal 23 is the center tap of the primary winding and is further coupled to a dc source such as a 28 Vdc source.

The drain terminal D of FET 19 is coupled to one side of the primary winding 14 and the drain terminal D of FET 20 is coupled to the other side of the primary winding 14. The respective sources S of FETs 19 and 20 are coupled to ground potential. In operation, a series of pulses are alternately applied to terminals 21 and 22 driving the FET switches into alternate on and off states. Operation of the FETs couples power to secondary winding 15.

The invention control process delivers even numbers of drive pulses of the ballast within phantom block 16 are delivered in even number pairs so that the ending pulse from one pulse GROUP is the opposite polarity from the starting pulse of the next pulse GROUP. If this condition is not met, then the lamp load is driven with double pulses of the same polarity resulting in a net dc voltage being applied to the primary 14 resulting in saturation.

Ten or more pulses are typically applied to the ballast at start up to initially increase the voltage applied to the lamp load. The increased voltage is necessary to strike or ionize the gas in the lamp and the increased voltage should be sustained until the lamp load is warmed.

Figure 2:
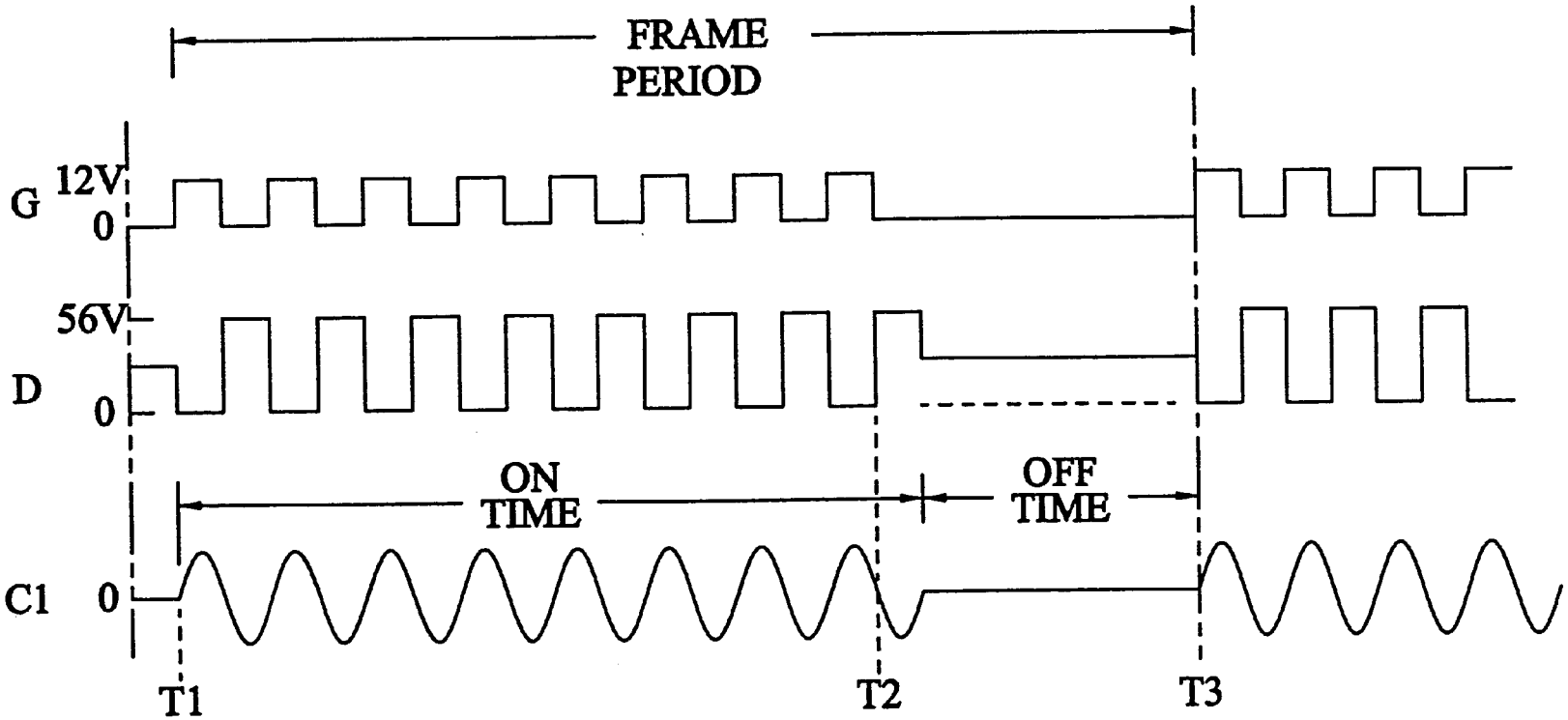
FIG. 2 is a waveform diagram illustrating a fixed frame rate and a variable duty cycle, for operation in the high brightness control range.

FIG. 2, schematically shows waveforms from FIG. 1 for a fixed frame rate control process for operation with a brightness in excess of a maximum brightness level. The threshold for entry into a maximum brightness level regime is a design choice. A level of 50% will be used for the purpose of illustration in this application.

The gate drive signal G is a conventional quasi square wave applied to the gate G terminals of the top FET 19. The "on-time" occurs between time T1 and T2; and, the "off-time" occurs between time T2 and T3. In the fixed frame rate control process of FIG. 2, the "on-time" and "off-time" are variable. The sum of the "ON TIME" and the "OFF TIME" is the period of the frame, its reciprocal being the frame rate or frequency. In the fixed frame rate process, the frame rate is constant.

Varying the "ON TIME" and the "OFF TIME" with a fixed frame rate permits the control and dimming of the lamp load in accordance with the first process of the present invention. Waveform D represents the voltage wave form on the drain 26 of FET 19. The waveform is switched to ground or zero volts as the waveform at G goes high turning FET 19 "ON". The waveform rises to twice the center tap voltage of 56 volts as the gate voltage goes to ground turning FET 19 "OFF" and as FET 20 is driven "ON". Waveform C1 illustrates the output voltage of the filter (i.e., L1 and C1) as applied to the lamps 10–13. A sine-wave is shown at the lamp drive-frequency with the same "ON TIME" and "OFF TIME".

Figure 3A:
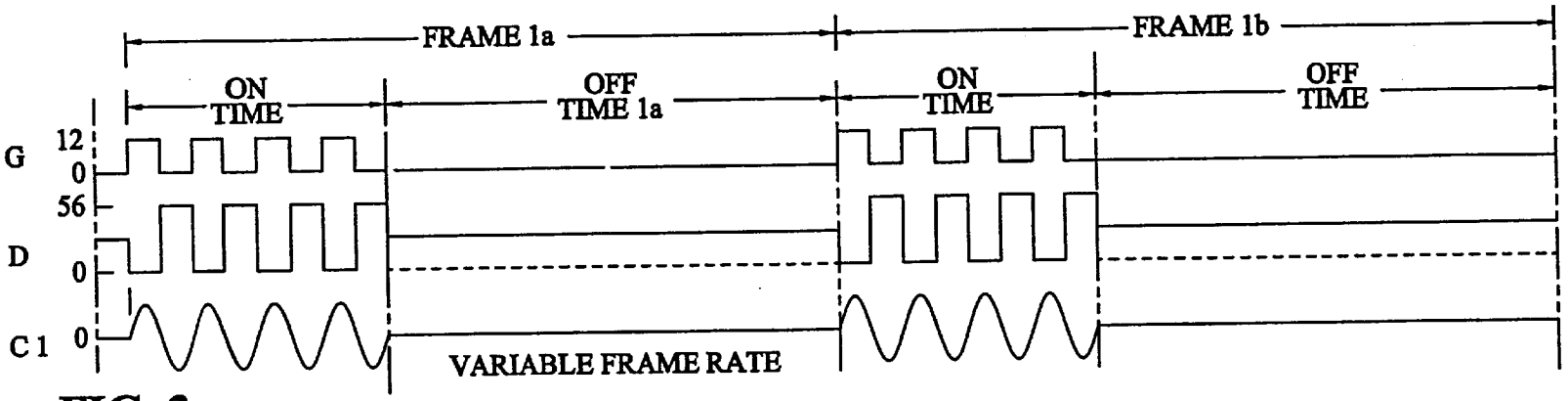
FIGS. 3*a* and 3*b* show two sets of waveforms typical of a system operating with a variable frame rate having a constant GROUP pulse count.
Figure 3B:
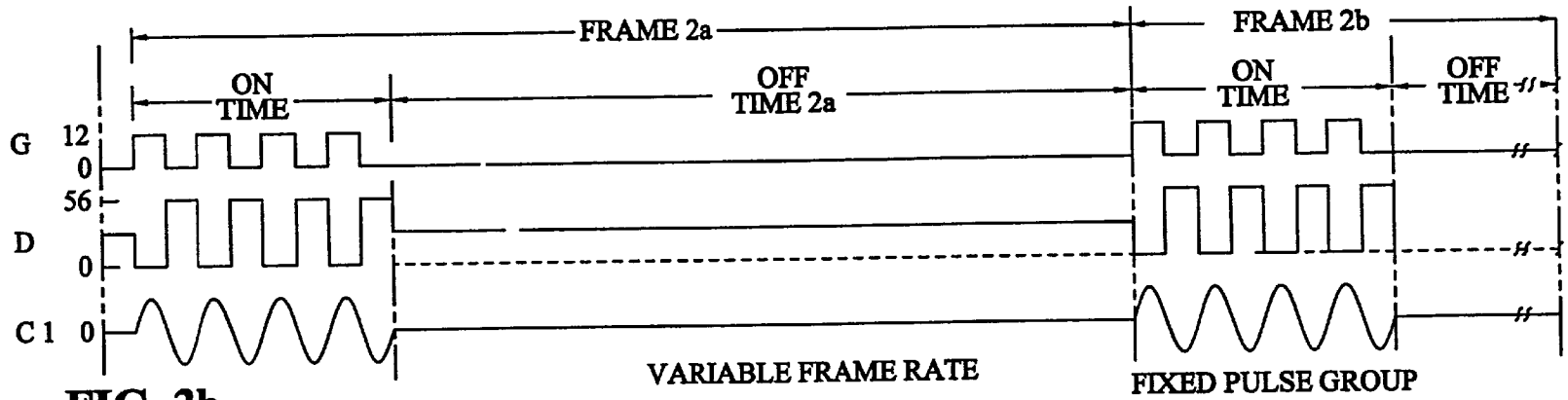

FIGS. 3*a* and 3*b* schematically show waveforms for a variable frame rate control process for operation with low brightness levels typically less than 50% of the maximum brightness level. The "ON TIME" is held constant and the "OFF TIME" is varied in the variable frame rate process. As shown, the "OFF TIME 1*a*" of FIG. 3*a* is clearly shorter than the "OFF TIME 2*a*" of FIG. 3*b*. The number of pulses that are delivered during the ON TIME is fixed, the same number of pulses appearing in both FIGS. 3*a* and 3*b*. To reduce the brightness, the "OFF TIME 1*a*" is increased to the value "OFF TIME 2*a*" as shown in FIG. 3*b*. As with FIG. 2, the frame time is the sum of the ON TIME and the OFF TIME and the frame rate is the reciprocal of the frame time. Frame 1*a* is shorter in duration than Frame 2*a* showing that the frame rate is variable. The three waveforms G, D and C1 in each of the FIGS. 3*a* and 3*b* have origins that correspond to the origins of waveforms G, D and C1 illustrated in FIG. 2.

START UP AND INITIALIZATION

Figure 4:
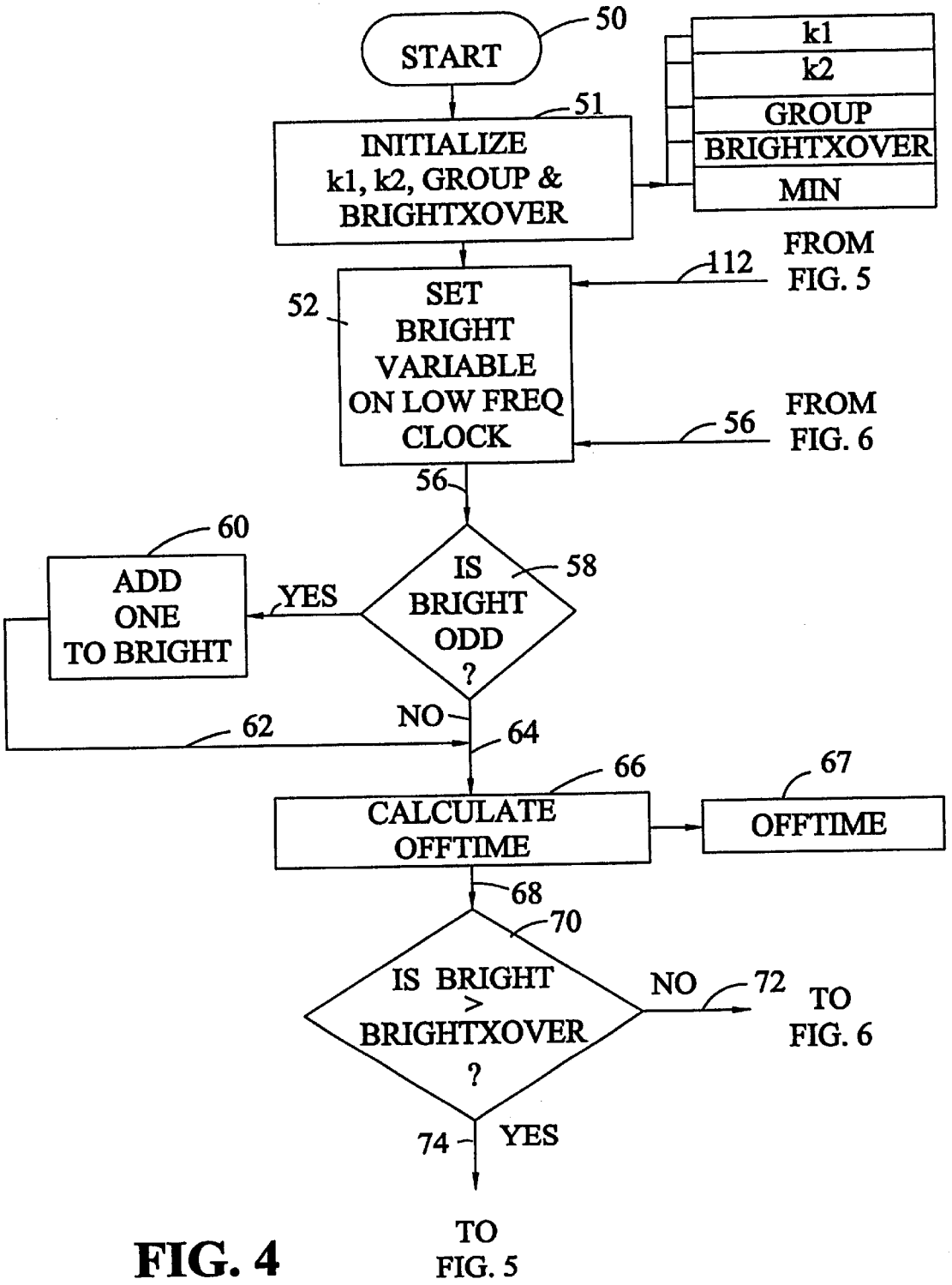
FIG. 4 is a flow chart showing the START point for the high brightness, fixed frame rate and low brightness, variable frame rate control processes.
Figure 5:
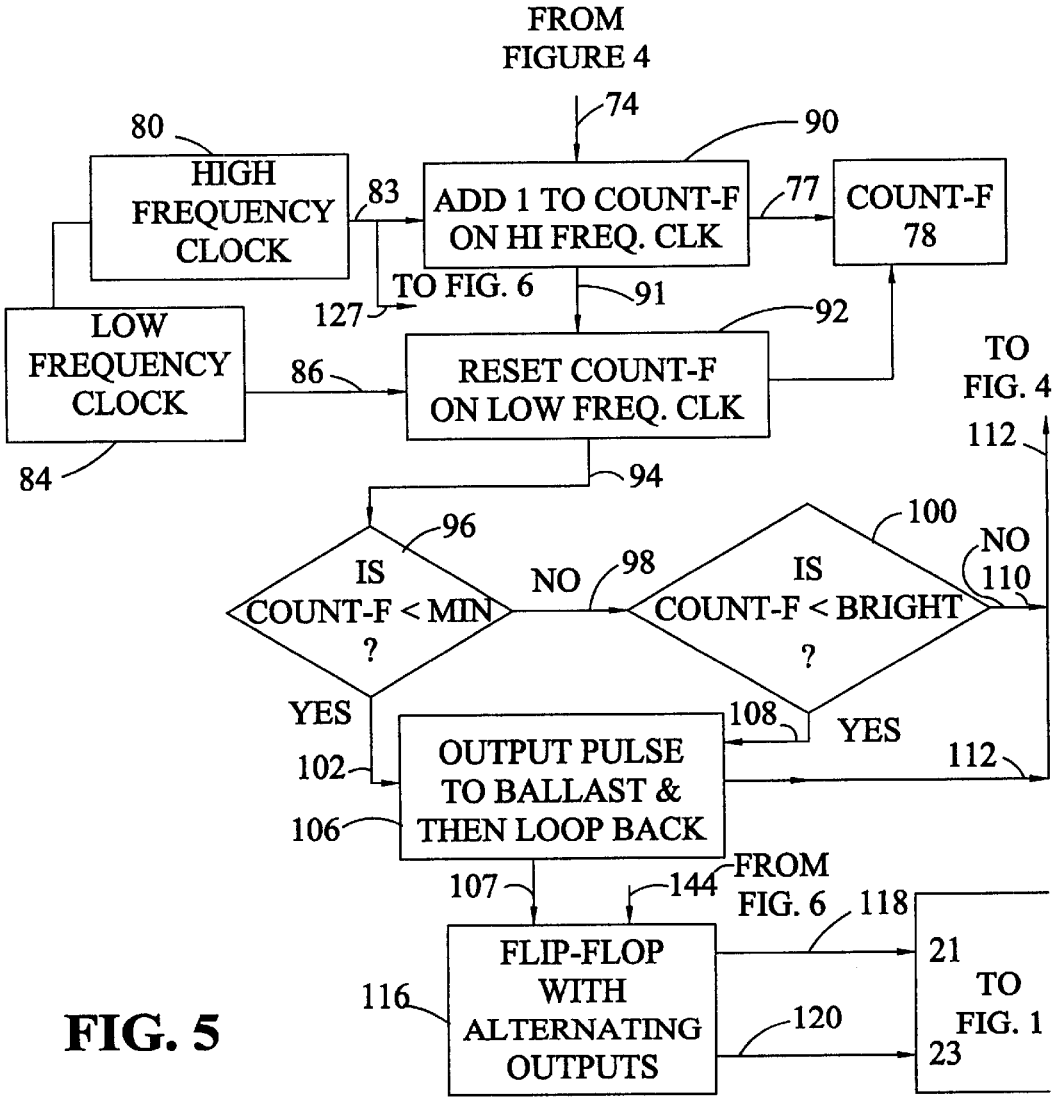
FIG. 5 is a flow chart for controlling the number of pulses in each frame for a fixed frame rate, high brightness control range.
Figure 6:
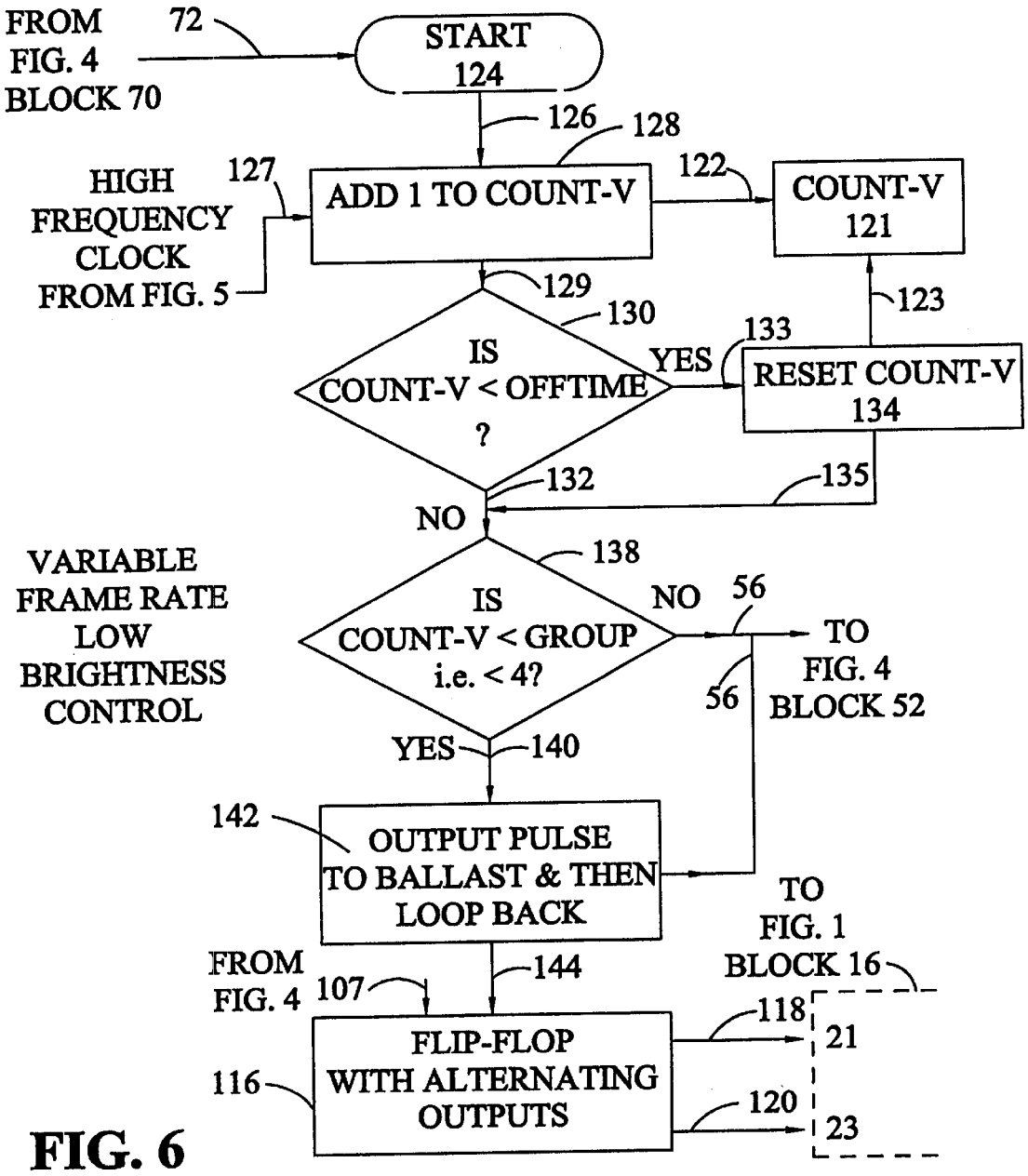
FIG. 6 is a flow chart for a variable frame rate process for controlling the number of pulses in each frame for a variable frame rate process.

The preferred embodiment of the present invention uses the fixed frame rate process for the control of the high brightness range of FIGS. 4 and 5 and the variable frame rate process of FIGS. 4 and 6 for the control of the low brightness range. The brightness level at which the control process transitions from a low to a high or from a high to a low is controlled by the design constant BRIGHT×OVER AND switches from a fixed frame rate to a variable frame rate or from a variable frame rate to a fixed frame rate depending on the direction of change of the variable BRIGHT.

For the purpose of this disclosure, the constant BRIGHT×OVER will be assumed to have been set to 50% of the full range of the variable BRIGHT as a design choice. FIGS. 4, 5, 6 show flow charts for the steps in a processes performed by a microprocessor, such as microprocessor 30 of FIG. 1, to accomplish the steps of the present invention.

The integrated process for an integrated low brightness range and a high brightness range control process in response to changes in the input variable BRIGHT signal with a seamless transition between the processes will now be discussed in connection with the embodiment of FIGS. 4, 5 and 6.

FIG. 4 shows the process starting at entry bubble 50 after which two constants, k1 and k2 are calculated in the step of block 51. The derivation of and the equations necessary for the calculation of the value of k1 and k2 is discussed later in this disclosure. The constants GROUP, BRIGHT×OVER and MIN are predetermined design choices and are initialized by read only memory, software or hard wire entries.

The process advances to block 52 representing the step SET BRIGHT VARIABLE ON LOW FREQUENCY CLOCK. The brightness required is expected to be commanded by a voltage into the microprocessor 30 originating from a pot, such as pot 53, on FIG. 1 or from a digital value on a signal line or buss 29 as shown in FIG. 1. The value of the voltage or digital value received is a variable and is designated as the variable BRIGHT.

Block 52 represents the step of sampling the value of the variable BRIGHT and inserting it into a latch or storage register before advancing along path 56 to decision block 58. Decision block 58 asks IS BRIGHT ODD? If the value of the variable BRIGHT is odd, the program advances via the YES branch to the ADD ONE TO BRIGHT block 60 forcing the digital value of the variable BRIGHT to become even. Path 62 leads path 64, and to the CALCULATE OFF TIME sub process at lock 66. When available, the value of OFFTIME is stored in register 67.

If the IS BRIGHT ODD decision block 58 determines that the value of BRIGHT is even, the process exits via NO path 64 to the CALCULATE OFF TIME sub process at block 66.

The variable OFFTIME in block 67 is used in the variable frame rate process and provides a measure of the time that the process will wait after a GROUP of pulses have been delivered to the lamp load before starting another frame. The equation for calculating the variable OFFTIME and its derivation is presented later in this specification. After the calculation of OFFTIME at block 66, the process proceeds via path 68 to the decision block 70 titled IS BRIGHT>BRIGHT×OVER? Recall that the value of BRIGHT×OVER is established above as an initialization constant.

The variable BRIGHT has a design range that is a design choice. The value of BRIGHT×OVER is that value of the variable BRIGHT at which the system transitions from a fixed frame rate regulation process at the high end of the brightness range to a variable frame rate process for regulation in the lower brightness range or vise versa.

If the value of BRIGHT is greater than BRIGHT×OVER, the process advances via path 74 to the fixed frame rate process for the high brightness range on FIG. 5. If the value of BRIGHT is equal to or less than BRIGHT×OVER, the process advances to the variable frame rate process via path 72 to FIG. 6.

FIXED FRAME RATE REGULATION FIG. 5

FIG. 5 illustrates the fixed frame rate process for controlling lamp brightness for values of BRIGHT above BRIGHT×OVER.

Path 74 on FIG. 4 connects to path 74 on FIG. 5 and to the ADD ONE TO COUNT-F ON HI FREQ. CLK, block 90. The COUNT-F block 78 represents a register that contains the digital value of a variable COUNT-F.

With each pass or program cycle through the process from FIG. 4 through FIG. 5, the variable COUNT-F in register 78 is incremented monotonically (in a single direction) upward one count as the HIGH FREQUENCY CLOCK block 80 passes a clock signal via path 83 to the ADD ONE TO COUNT-F ON HI FREQ. CLK, block 90. The variable COUNT-F represents the total of all past increments from the start of a frame. The COUNT-F register 78 could be a register to which one is added on each pass or a counter.

The process then advances via path 91 to the block titled RESET COUNT-F ON LOW FREQ CLK, block 92. The LOW FREQUENCY CLOCK is received via path 86 at block 92 from the LOW FREQ. CLOCK BLOCK 84. The function of block 92 is to reset the value of the variable COUNT-F to zero on the arrival of each low frequency clock pulse signal signaling the end of the present frame and the beginning of the next frame. The low frequency clock on signal line 86 is typically a pulse at a 60 HZ to 240 HZ low-frequency ("LF") clock rate.

In the absence of a low frequency clock signal, the process advances via path 94 to the IS COUNT-F<MIN ? decision block 96. Recall that the value of the variable MIN is a predetermined constant and it was set during fabrication or at the start up initialization process on FIG. 4 at block 51. MIN represents the smallest number (such as 4) of pulses that the fixed frame process will be allowed to output in a frame. Empirical tests have shown that reliable operation requires a minimum number of pulses, such as four pulses, must be supplied in each frame to prevent lamp flicker.

If the decision at decision block 96 is YES, the process exits via path 102 to the OUTPUT PULSE TO BALLAST & THEN LOOP BACK block 106 via signal path 112 to FIG. 4, passing again through blocks 52, 58, 66, 70, to 90 where COUNT-F is again incremented, to 92 to again test the IS COUNT-F<MIN ? at decision block 96. Each pass though Block 106 outputs a pulse via path 107 to the block titled FLIP-FLOP WITH ALTERNATING OUTPUTS, block 116 which sends a pulse on path 118 or in the alternative, path 120 to the respective gates 21, 22 of the ballast drive FETS on FIG. 1.

As the value of COUNT-F increases, eventually the process will test the IS COUNT-F<MIN decision block 96 and determine that COUNT-F is not less than MIN, at which pass the process proceeds via NO path 98 to the IS COUNT-F<BRIGHT? decision box 100. If the decision is YES, signaling that added pulses are required, the process advances via path 108 to the OUTPUT PULSE TO BALLAST & THEN LOOP BACK block 106. Block 106 then outputs a pulse via path 107 to the block titled FLIP-FLOP WITH ALTERNATING OUTPUTS, block 116 and as before, Block 116 sends a pulse via path 118 or in the alternative, path 120 to the respective gates 21, 22 of the ballast drive FETS on FIG. 1.

Block 106 also outputs a pulse via signal path 112 to FIG. 4 to the SET BRIGHT VARIABLE ON LOW FREQ CLOCK block 52 to begin another program cycle or frame.

The process continues to cycle back to FIG. 4, returning to FIG. 5, to block 90 to increment the variable COUNT-F. When the value of the variable COUNT-F equals or exceeds the value of the variable BRIGHT, and as the process follows path 98 to test the IS COUNT-F<BRIGHT? decision block 100, a NO result is produced and the process follows path 110 to FIG. 4. No output pulses are produced as this path is followed.

The first NO decision of block 100 starts the OFF time interval shown on FIG. 2 extending from T2 to T3. With each NO obtained by following the path back to block 100, the program advances from decision block 100 via path 110 to path 112 and then back to block 52 on FIG. 4 without sending a pulse to the FLIP-FLOP WITH ALTERNATING OUTPUTS, block 116.

At the end of the frame period, shown as time T3 in FIG. 3, the LOW FREQUENCY CLOCK block 84, shown on FIG. 5 sends a pulse to the RESET COUNT-F ON LOW FREQ block 92 which responds with a reset pulse via path 93 to reset the variable COUNT-F value to zero to start the next frame period.

VARIABLE FRAME RATE PROCESS OF FIG. 6

Referring again to FIG. 4, if the process proceeds to the IS BRIGHT>BRIGHT×OVER? decision block 70 and determines that the answer is NO, the process has determined that the brightness level that is commanded is in the low brightness regime and jumps to the START entry bubble 124 on FIG. 6.

The variable frame rate process uses a fixed and even number of pulses in each frame. The fixed number is a predetermined constant called GROUP and has a value, that is a design choice such as four (4). The process will thereafter output four pulses in each frame such as depicted by FIGS. 3*a* and 3*b*.

Referring again to FIG. 6, after entry at the START bubble 124, the process advances via path 126 to the ADD 1 TO COUNT-V, block 128 which responds to a clock from the HIGH FREQUENCY CLOCK source 80 via path 127 from FIG. 5, to increment the value of the variable COUNT-V contained in the COUNT-V register 121 via path 122 by one count.

The process next advances via path 129 to test the IS COUNT-V>OFFTIME? decision block 130. If the value of the variable COUNT-V is less than the value of the variable OFFTIME, the process advances via NO path 132 to test the IS COUNT-V<GROUP?, decision block 138.

If, on the other hand, the value of the variable COUNT-V in block 121 equals or exceeds the value of the variable OFFTIME, the process advances from decision block 130 via YES path 133 to the RESET COUNT-V block 134 at which point the value of the variable COUNT-V is set to zero preparatory to the start of the next frame or program cycle. After resetting the variable COUNT-V, the process advances from block 134 via path 135 to the IS COUNT-V<GROUP?, decision block 138.

The purpose of the IS COUNT-V<GROUP?, decision block 138 is to insure that a predetermined number of pulses are sent to the ballast 16 via FLIP-FLOP 116 at the start of a each new frame. If the value of GROUP is set to four, the process will pass through decision block 138 four times via YES path 140 to the OUTPUT PULSE TO BALLAST & THE LOOP BACK, block 142. On the fifth pass to decision block 138, the value of the variable COUNT-V equals the value of GROUP and the process exits the decision block 138 via the NO path 56 and returns to the SET BRIGHT VARIABLE ON LOW FREQ CLOCK block 52 on FIG. 4 and starts the next frame cycle thereby avoiding the output of a pulse and initiating the start of the OFF TIME depicted as 1*a* or 2*a* in FIGS. 3*a* and 3*b* respectively. Referring again to FIG. 6, each time the process passes via the OUTPUT PULSE TO BALLAST & THE LOOP BACK block 142, block 142 outputs a pulse via signal path 144 and also outputs a pulse via path 56 to the SET BRIGHT VARIABLE ON LOW FREQ CLOCK block 52 on FIG. 4 to initiate the next frame cycle.

During the first four passes via YES path 140, the OUTPUT PULSE TO BALLAST & THEN LOOP BACK block 142 outputs a pulse via path 144 to the FILP-FLOP WITH ALTERNATING OUTPUTS block 116 which alternately toggles outputs pulses via signal lines 118 and 120 to the gates 21 and 22 on FIG. 1.

While in the low brightness regime, with each return to block 52 via path 56, the program advances past decision blocks 58, and 66 to decision block 70 where, if the value of the variable BRIGHT has not changed, the process exits on the NO path 72 back to FIG. 6 and START bubble 124. Once the variable COUNT-V exceeds GROUP at decision block 138, the process exits decision block 138 on the NO path 56 as often as required, with no pulses being produced by FILP-FLOP WITH ALTERNATING OUTPUTS block 116 until the variable COUNT-V exceeds OFFTIME and the RESET COUNT-V block 134 resets the value of the COUNT-V variable in register 121 to zero.

It can be seen that, with minor modifications, the fixed frame rate process and the variable frame rate processes can be used separately. The process shown in FIGS. 4, 5 and 6 combines the fixed frame rate process for the high brightness range and the variable frame rate process for the low brightness range with the combined process seamlessly transitioning from the first to the second at the BRIGHT×OVER transition point. As brightness is increased in the low brightness range from a low level to a higher level, the variable frame rate frequency increases, the transition typically being set to occur when the frequency exceeds 1 KHz.

The following explanation will show how the several constants necessary for the initialization of the processes are developed, and what assumptions were used in the development process.

For the high brightness range of control the average light output is assigned the variable AVGLIGHT. The average light output is a function of the duty ratio and varies in accordance with equation 1a as follows:

$$\text{AVGLIGHT}=\text{BRIGHT}/\text{PERIOD} \quad \text{1a.}$$

where BRIGHT is the user set value of brightness, a design choice. As explained above, the variable BRIGHT is adjusted by the user to adjust light output. The variable PERIOD is the total time for a frame in the fixed frame rate mode.

The output pulse rate is equal to the program cycle rate, CLOCKFREQUENCY, driven by the High Frequency Clock 80. The maximum number of pulses in a frame period is equal to the variable MAXCOUNT and is therefore:

$$\text{MAXCOUNT}=\text{PERIOD}/\text{CLOCKFREQUENCY} \quad \text{1b.}$$

The average light output AVGLIGHT is proportional to the variable BRIGHT. The ON TIME is made proportional to BRIGHT resulting in:

$$\text{AVGLIGHT}=\text{BRIGHT}/\text{MAXCOUNT} \quad \text{2a.}$$

The low brightness range uses the variable frame rate control process. This process varies the OFF TIME and uses a constant assigned the term ON TIME. The value assigned to the term ON TIME is the time required to deliver the predetermined number of drive pulses. The predetermined number of pulses is a constant called GROUP.

$$\text{AVGLIGHT}=\text{ON TIME}/(\text{ON TIME}+\text{OFFTIME}) \quad \text{3.}$$

Substituting the variable GROUP for the term ON TIME provides equation 4:

$$\text{AVGLIGHT}=\text{GROUP}/(\text{GROUP}+\text{OFFTIME}) \quad \text{4.}$$

It is necessary to fix the relationship between the fixed frame rate process and the variable frame rate process such that an increase in the variable BRIGHT will cause the duty ratio to increase for each with a seamless transition. However, an increase in the variable OFFTIME reduces the duty ratio. To achieve correspondence, the variable OFFTIME in equation 4 is made a function of the variable BRIGHT as follows in equation 5:

$$\text{OFFTIME}=\text{k1}*(\text{k2}-\text{BRIGHT}) \quad \text{5.}$$

Substituting equation 5 into equation 4:

$$AVGLIGHT = \frac{GROUP}{GROUP + k1*(k2 - BRIGHTXOVER)} \quad \text{6.}$$

The transition point for the AVGLIGHT of the fixed frame rate process of equation 2 is forced to be equal to the AVGLIGHT of the variable frame rate process of equation 6 by naming the value of the variable BRIGHT at the crossover BRIGHT×OVER. Substituting the particular value of BRIGHT×OVER for BRIGHT in both equation 2 and 6 and setting the right half of each of the two equations equal to each other obtains equation 7 below:

$$\frac{BRIGHTXOVER}{MAXCOUNT} = \frac{GROUP}{GROUP + k1*(k2 - BRIGHTXOVER)} \quad \text{7.}$$

To match the sensitivity of both processes to the variable BRIGHT, a partial derivative is taken of both sides at the value of BRIGHT equal to BRIGHT×OVER:

$$\frac{\partial}{\partial BRIGHTXOVER}\left[\frac{BRIGHTXOVER}{MAXCOUNT} = \frac{GROUP}{GROUP + k1*(k2 - BRIGHTXOVER)}\right] \quad 8.$$

$$\frac{1}{MAXCOUNT} = \frac{GROUP*k1}{(BRIGHTXOVER*k1 - GROUP - k1*k2)^2} \quad 9.$$

Equations 7 and 9 were solved for the values of k1 and k2 using the DERIVE 5 program from Texas Instrument to obtain the following relationships:

$$SOLVE\left[\frac{BRIGHTXOVER}{MAXCOUNT} = \frac{GROUP*k1}{GROUP + k1*(k2 - BRIGHTXOVER)}\right] \quad 10.$$

$$k1 = \frac{GROUP*(BRIGHTXOVER - MAXCOUNT)}{BRIGHTXOVER*(BRIGHTXOVER - k2)} \quad 11.$$

$$\frac{1}{MAXCOUNT} = \frac{BRIGHTXOVER*(BRIGHTXOVER - MAXCOUNT)}{(MAXCOUNT)^2*(BRIGHTXOVER - k2)} \quad 12.$$

$$SOLVE\left[\frac{1}{MAXCOUNT} = \frac{BRIGHTXOVER*(BRIGHTXOVER - MAXCOUNT)}{MAXCOUNT^2(BRIGHTXOVER - k2)}, k2\right] \quad 13.$$

The constants k1 and k2 are now solved for to relate the variable OFFTIME to the variable BRIGHT:

$$k2 = \frac{BRIGHTXOVER*(2*MAXCOUNT - BRIGHTXOVER)}{MAXCOUNT} \quad 14.$$

$$k1 = \frac{GROUP*MAXCOUNT}{BRIGHTXOVER^2} \quad 15.$$

With the design constants for GROUP, MAXCOUNT AND BRIGHT×OVER selected, the values of k1 and k2 are calculated for use in the initialization process of FIG. 4.

Figure 7:
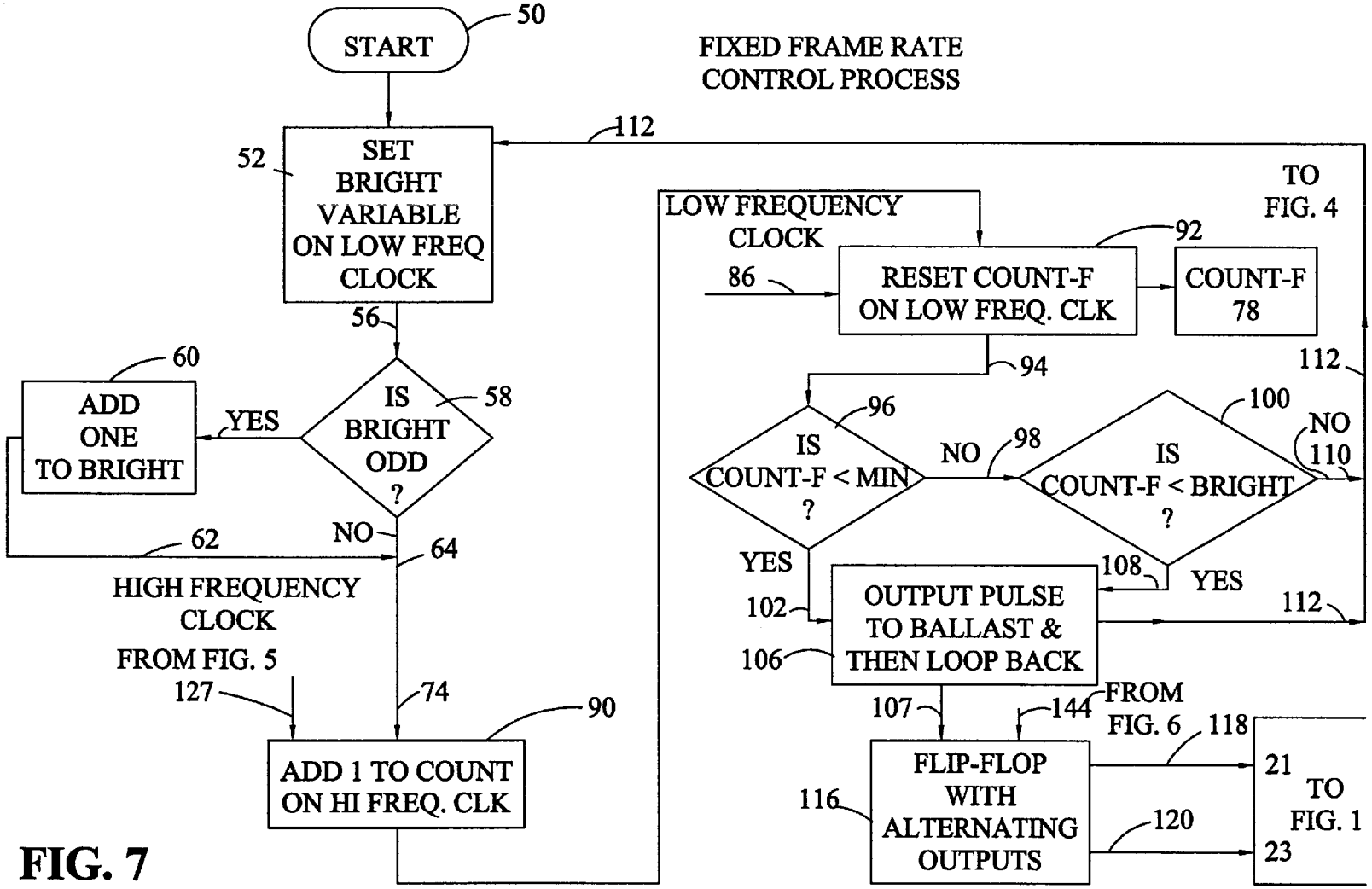
FIG. 7 is a flow chart for a fixed frame rate control process simplified from FIGS. 4 and 5.

FIG. 7 is derived from FIGS. 4 and 5 and shows the steps in the fixed frame rate method of providing drive signals to a ballast to control the brightness of a fluorescent lamp load. The fixed frame rate method comprises the steps of:

A. Providing a high frequency clock signal, such as the clock signal provided by block 80 on FIG. 5.

B. Monotonically incrementing the value of a digital variable COUNT-F, as in block 90 with the high frequency clock signals on signal line 127. The digital value of the variable COUNT-F counts from an initial value to a predetermined final value in a frame interval of fixed duration. The value of the digital number COUNT-F is reset, by the LOW FREQUENCY CLOCK on line 86, to the initial value at the end of each frame interval as shown in block 92.

C. Sampling an input signal, such as BRIGHT, and scaling the sample to form a digital input variable BRIGHT. This step is represented by block 52 and is performed after the START bubble 50 but before decision block 100 is tested. The digital value of BRIGHT is scaled to represent a portion of the value of the range of the variable COUNT-F, stored in the COUNT-F. register 78 shown on FIG. 5.

D. While the value of COUNT-F is incrementing monotonically from its initial value, such as zero, to a value equivalent to the value of the BRIGHT variable, the process uses the step of block 106 to output a ballast pulse of power to the lamp load for each increment of the value of the COUNT variable that results in a YES result from decision from block 100 via signal path 108.

At the conclusion of the ADD 1 TO COUNT-F ON HI FREQ CLK, block 90 of step B and before step C, the method enters decision block 96 to test IS COUNT-F<MIN to determine if the value of the variable COUNT-F is less than a predetermined digital value MIN. Decision block 96 thereby insures that a minimum number of pulses will be delivered to the lamp during each frame without regard to decision block 100. Therefore, even if the value of BRIGHT is zero, a minimum MIN number of drive pulses will be output via signal paths 102 and block 106 for each frame that is started. A minimum level of drive maintains the lamps in a warm ready state.

E. Steps C and D are repeated until operation is interrupted. As the value of COUNT-F reaches and equals that of BRIGHT, decision block 100 guides the process via the NO signal line 110 to return to block 52 via signal path 112 as many times as required without outputting a pulse to the ballast. Path 112 is followed until the variable COUNT-F is reset by the low frequency clock on signal line 86 to leading to block 92.

During or before step B the method enters decision block 58 and tests to see IS BRIGHT ODD?. The object of this test is to increment BRIGHT as required to make it even so that the number of pulses commanded to block 116 will be even thereby insuring that the ballast will not have its transformer core walked to a saturation limit.

Figure 8:
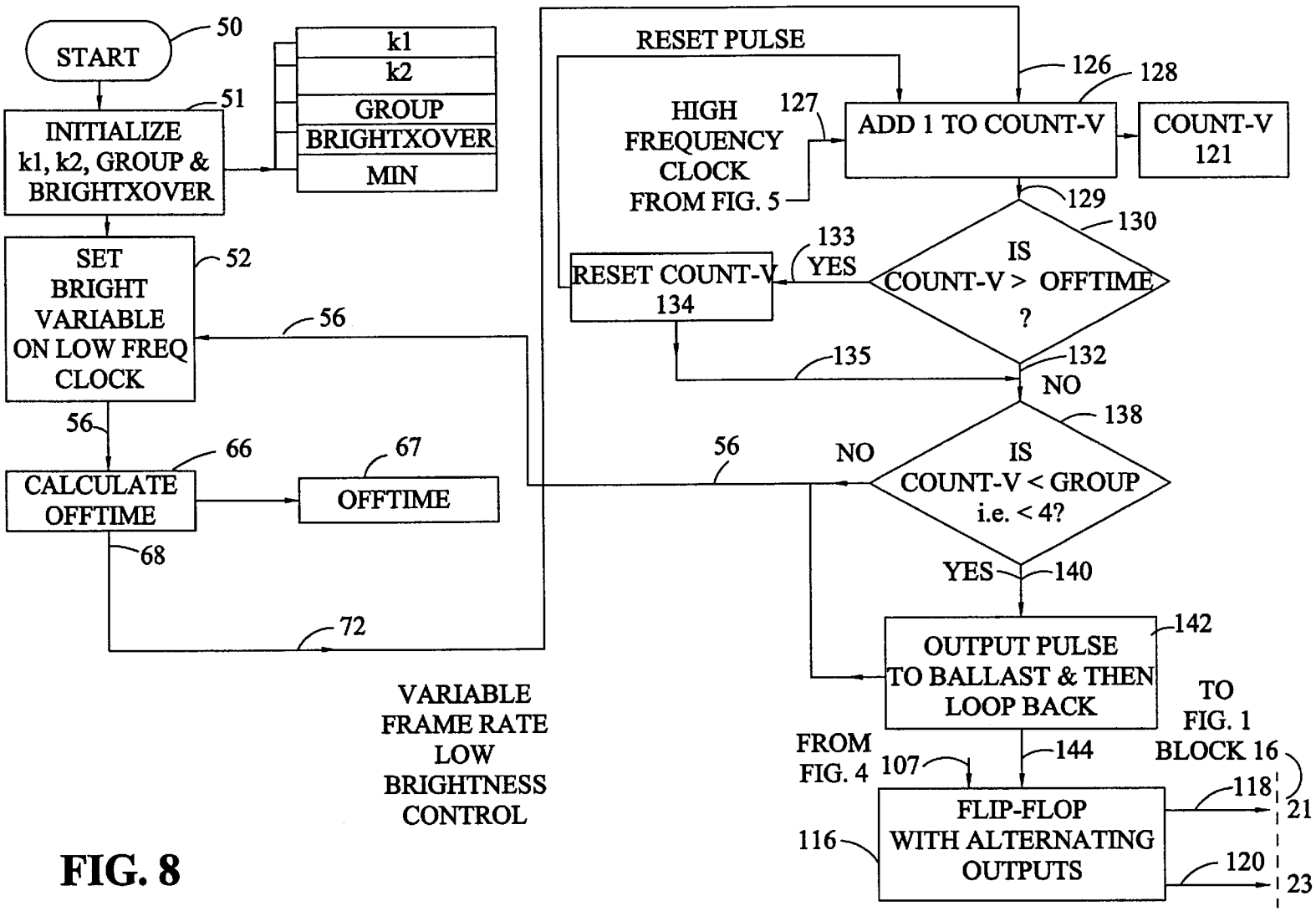
FIG. 8 is a flow chart for a variable frame rate control process simplified from FIGS. 4 and 6.

FIG. 8 is derived from FIGS. 4 and 6 and shows the steps in the variable frame rate method of providing drive signals to a ballast to control the brightness of a fluorescent lamp load. The method of FIG. 8 comprises the steps of:

A. Providing a high frequency clock signal to a counter or register 128 via a signal line 127 from a source, such as that shown on FIG. 5. Referring to block 51 on FIG. 8, establishing the value of a digital constant, GROUP, that characterizes a fixed number of ballast pulses of power to be delivered to a lamp load during each frame of a continuing series of frame intervals of variable duration.

B. Block 128 depicts the step of monotonically incrementing the value of the digital number COUNT-V with the high frequency clock signals arriving on signal line 127. The value of COUNT-V counts from an initial value, such as zero, to a variable final value in each frame interval of variable duration.

C. The step of block 52 of sampling an input signal and scaling the sample to form a digital input variable BRIGHT. If the signal were from a pot, using an analog to digital converter to create the digital value of BRIGHT in a register or latch register. Scaling the value of BRIGHT as required. Block 66 shows the step of using the scaled value of BRIGHT to calculate the value of a variable OFFTIME which provides a measure of the time that the process will wait after a predetermined GROUP of pulses have been delivered to the lamp load before starting another frame. The equations for the calculation of OFFTIME appear above.

D. Incrementing the value of COUNT-V, as in block 128, and determining if the value of COUNT-V exceeds the digital value of a variable OFFTIME as in block 130 and if true, resetting the value of COUNT-V to its initial value as by block 134. Advancing via path 132 to decision block 138.

E. Block 138 tests to see if COUNT-V is less or equal to GROUP and if true, advancing to step F. If COUNT-V is greater than GROUP at this test, the process follows NO path 56 back to block 52 without delivering an output pulse. The process then continues to loop from blocks 52 to 66 to 128, to 130 and back to 138 as required until block 130 determines that COUNT-V is greater than OFFTIME at which point the frame is ended preparatory to starting the next frame. Steps C, D and E are repeated in the process.

F. Step F is performed as decision block 138 determines that the value of COUNT-V is less than GROUP after which the process uses YES path 140 to output a ballast pulse using blocks 142 and 116 as described above in connection with the fixed frame rate process of FIG. 7.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A fixed frame rate method of providing drive signals to a ballast to control the brightness of a fluorescent lamp load, the method comprising the steps of:

A. providing a high frequency clock signal,

B. monotonically incrementing the value of a digital variable COUNT-F with the high frequency clock signals, the digital value of the variable COUNT-F COUNT-Fing from an initial value to a final value in a frame interval of fixed duration, the value of the digital number being reset to the initial value at the end of each frame interval, C. sampling an input signal and scaling the sample to form a digital input variable BRIGHT, the digital value of BRIGHT being scaled to represent a portion of the value of the range of variable COUNT-F, D. while the value of COUNT-F is incrementing monotonically from its initial value to a value equivalent to the value of the BRIGHT variable, outputing a ballast pulse of power to the lamp load with each increment of the value of the COUNT-F variable, and E. repeating steps C and D.

2. The method of claim 1 wherein step B further comprises the step of advancing to step D if the value of the variable COUNT-F is less than a predetermined digital value MIN.

3. The method of claim 1 wherein step B. further comprises:

determining if the value of the variable BRIGHT is odd and if the value of BRIGHT is odd, incrementing the digital value of BRIGHT to be even.

4. The method of claim 1 where in step A. further comprises the step of:

providing a low frequency clock signal, the low frequency clock signal having a period equal to the frame interval, and wherein step B, the digital number counting from an initial value is further characterized to be in a digital register, the digital register being reset to the initial value with each low frequency clock signal.

5. The method of claim 1 wherein step B further comprises the step of advancing to step D if the value of the variable COUNT-F is less than a predetermined digital value MIN, and wherein step C. further comprises the step of determining if the value of the variable BRIGHT is odd and if the value of BRIGHT is odd, incrementing the digital value of BRIGHT to be even.

6. The method of claim 1 wherein step B further comprises the step of advancing to step D if the value of the variable COUNT-F is less than a predetermined digital value MIN, and wherein step A. further comprises the step of:

providing a low frequency clock signal, the low frequency clock signal having a period equal to the frame interval, and wherein step B, the digital number counting from an initial value is further characterized to be in a digital register, the digital register being reset to the initial value with each low frequency clock signal.

7. The method of claim 1 wherein step B further comprises the step of advancing to step D if the value of the variable COUNT-F is less than a predetermined digital value MIN, and step C. further comprises:

determining if the value of the variable BRIGHT is odd and if the value of BRIGHT is odd, incrementing the digital value of BRIGHT to be even, and step A. further comprises the step of:

providing a low frequency clock signal, the low frequency clock signal having a period equal to the frame interval, and wherein step B, the digital number counting from an initial value is further characterized to be in a digital register, the digital register being reset to the initial value with each low frequency clock signal.

8. A variable frame rate method of providing fixed frame rate drive signals to a ballast to control the brightness of a fluorescent lamp load, the method comprising the steps of:

A. providing a high frequency clock signal and establishing the value of a digital constant GROUP characterizing a number of ballast pulses of power to be delivered to a lamp load during a continuing series of frame intervals of variable duration, B. monotonically incrementing the value of a digital number COUNT-V with the high frequency clock signals, the value of COUNT-V counting from an initial value to a variable final value in each frame interval of variable duration, C. sampling an input signal and scaling the sample to form a digital input variable BRIGHT, the digital value of BRIGHT being scaled and used to calculate the value of a variable OFFTIME, a measure of the time that the process will wait after a predetermined GROUP of pulses have been delivered to the lamp load before starting another frame, D. determining if the value of COUNT-V exceeds the digital value of a variable OFFTIME and if true, setting the value of COUNT-V to its initial value, E. determining if the value of COUNT-V is less than the value of GROUP and if true, advancing to step F. and if false returning to step C. to complete steps C, D and E, F. outputing a ballast pulse of power to the lamp load and returning to step C to complete steps C, D and E.

9. A method of providing drive signals to a ballast to control the brightness of a fluorescent lamp load the method comprising the steps of:

a. incrementing a counter with a high-frequency clock, the value of the counter representing a first variable, COUNT-F, b. resetting the counter with a low-frequency clock having a low frequency clock period if the low frequency clock period has expired;

c. determining if the first variable COUNT-F is less than a second variable BRIGHT, where BRIGHT is a signal value supplied to command the average brightness of the lamp load, and if the variable COUNT-F is less than the second variable BRIGHT, supplying a pulse to the array of lamps for illumination thereof, d. repeating steps "a" through "c".

10. The method of claim 9 wherein step c. further comprises the step of determining that the first variable COUNT-F is equal to or greater than the second variable BRIGHT, and immediately, repeating steps "a" through "c".

11. The method of claim 9 further comprising:

b2. determining that the value of the first variable COUNT-F is less than a third variable, MIN, where MIN is equal to the predetermined minimum number of ballast pulses of power to the lamp load, b3. selectively supplying the high-frequency pulses to the array of lamps for illumination thereof, and repeating steps "a", b, b2, b3 and "c".

12. The method of providing drive signals to a ballast to control the brightness of a fluorescent lamp load as in claim 9 wherein the first variable COUNT-F is less than the third variable MIN and less than the second variable BRIGHT, further including the step of adding one (1) to the counter containing the first variable COUNT-F on arrival of the next high-frequency clock.

13. The method providing drive signals to a ballast to control the brightness of a fluorescent lamp load as in claim 9 further comprising the steps of:

a. determining if the brightness setting is an odd number, and if yes;

b. adding one to the third variable BRIGHT to make it an even number.

14. A method of providing drive signals to a ballast to control the brightness of a fluorescent lamp of claim 9 further comprising the step of determining if the first variable bright exceeds a fourth variable BRIGHT×OVER characterizing a threshold for the first variable BRIGHT above which a fixed frame rate process will be used and below which a variable frame rate process will be used, the variable frame rate process having steps of d. determining if the variable COUNT-V is greater than a fourth variable OFFTIME indicative of period remaining until the start of the next frame, and if yes, resetting the counter, and;

e. determining if the variable COUNT-V is less than a constant GROUP, which equals the minimum number of pulses in a GROUP of pulses supplied to the lamps, and if yes;

f. selectively supplying a pulse to the array of lamps for illumination thereof and then resetting incrementing the first variable COUNT-V.

15. A fluorescent ballast control process comprising:

a low brightness control process to control the brightness of a fluorescent lamp load over a brightness range extending from a lowest brightness level through a lowest brightness range up to a predetermined intermediate brightness level using a variable frame rate, and a high brightness control process to control the brightness of the fluorescent lamp load over a brightness range extending from a the intermediate brightness level through a high brightness range using a fixed frame rate up to a predetermined maximum brightness level, and means for transitioning from the low brightness control process to the high brightness control process seamlessly in response to a variable control signal input, BRIGHT.

16. The fluorescent ballast control process of claim 15 wherein the low brightness control process and the high brightness control process are mutually exclusive digital control processes executed by a microprocessor programmed to continuously execute the low brightness control process program to provide drive pulses to the fluorescent ballast or the high brightness control process program to provide drive pulses to the fluorescent ballast.

17. The fluorescent ballast control process of claim 15 wherein the transition from the low brightness control process to the high brightness control process is executed in response to the control signal having a value exceeding the value of a predetermined constant BRIGHT×OVER, the transition being made substantially seamlessly with a constant control signal sensitivity.

18. The fluorescent ballast control process of claim 15 further comprising the step of providing an adjustable control signal to adjust and control the brightness of the lamp load, the control signal being a digital number (BRIGHT), and providing a numerical constant MAXCOUNT equal to the maximum number of pulses possible in a frame.

19. The fluorescent ballast control process of claim 15 further comprises the step of providing a numerical constant BRIGHT×OVER, the value of BRIGHT as the brightness crosses from the low brightness control process to the high brightness control process and from the high brightness control process to the low brightness control process, providing a constant equal to GROUP, the minimum even number of drive pulses within a GROUP of pulses, the program being characterized to calculate a slope constant (k1) and an off set constant (k2), the slope and offset constants being used to calculate a dimming variable (off-time) where OFFTIME=k1*(k2−BRIGHT) to characterize the duration of the quiescent period following the on-time.

20. The fluorescent ballast control process of claim 19 wherein the process begins with the step of comparing the value of BRIGHT with the value of BRIGHT×OVER to determine if the difference requires that the ballast control process enter into the low brightness control process or if the ballast control process difference requires entry into the high brightness control process, a determination having been made, the ballast control process advancing to the appropriate high brightness or low brightness process.

21. The fluorescent ballast control process of claim 19 wherein the steps of calculating the variables k1 and k2 further comprises the steps of calculating:

k2=(BRIGHT×OVER(2*MAXCOUNT−BRIGHT×OVER))/MAXCOUNT and k1=(GROUP*MAXCOUNT)/BRIGHT×OVER^2.

* * * * *